United States Patent [19]

Deguchi et al.

[11] Patent Number: 4,600,822

[45] Date of Patent: Jul. 15, 1986

[54] MICROSTRIPLINE FOR USE IN MICROWAVE HEATING

[75] Inventors: Yutaka Deguchi, Himeji; Yoshitaka Shibata, Hyogo, both of Japan

[73] Assignee: Sanyo Electric Co., Ltd., Japan

[21] Appl. No.: 582,327

[22] Filed: Feb. 22, 1984

[30] Foreign Application Priority Data

Jul. 19, 1983 [JP] Japan ..... 58-132385

[51] Int. Cl.[4] ..... H05B 6/70

[52] U.S. Cl. ..... 219/10.55 A; 219/10.55 F; 174/35 MS; 174/36; 333/243; 333/246

[58] Field of Search ..... 219/10.55 A, 10.55 F, 219/10.55 R, 10.81; 333/243, 244, 238, 246; 174/36, 35 MS; 361/220

[56] References Cited

U.S. PATENT DOCUMENTS

| | | | |
|---|---|---|---|
| 2,821,611 | 1/1958 | Mann et al. | 219/10.81 X |
| 3,612,744 | 10/1971 | Thomas | 333/243 X |
| 3,671,709 | 6/1972 | Gidge | 219/10.81 X |
| 3,735,022 | 5/1973 | Estep | 333/243 X |
| 3,763,306 | 10/1973 | Marshall | 333/243 X |
| 3,854,021 | 12/1974 | Moore et al. | 219/10.55 F |
| 4,382,236 | 5/1983 | Suzuki | 333/238 X |

FOREIGN PATENT DOCUMENTS

| | | | |
|---|---|---|---|
| 57-101374 | 6/1982 | Japan | 219/10.55 A |
| 57-154791 | 9/1982 | Japan | 219/10.55 A |

*Primary Examiner*—Philip H. Leung
*Attorney, Agent, or Firm*—Darby & Darby

[57] ABSTRACT

A microstripline for use in a microwave heating comprising conductors each provided over both surfaces of a dielectric base plate. A plurality of slits are arranged distributed in the propagating direction of a microwave on at least one conductor, thereby to form a ladder portion. At least one conductor having the ladder pattern is sandwiched by a silicone resin.

1 Claim, 4 Drawing Figures

MICROSTRIPLINE FOR USE IN MICROWAVE HEATING

BACKGROUND OF THE INVENTION

1. Field of the Invention

The present invention generally relates to a microstripline. More particularly, the present invention relates to a microstripline for use in a microwave heating apparatus, for example, adapted for uniformly heating a sheet-like material such as a paper sheet and a surface of other type of a material being heated.

2. Description of the Prior Art

Conventionally, a microwave heating apparatus using a microstripline in which a ladder pattern is formed in its ground conductor has been known for microwave heating of a thin material being heated such as a paper sheet. For example, the Japanese Patent Laying Open Gazette No. 14488/1983 laid open Jan. 27, 1984, discloses such microwave heating apparatus. FIG. 1 is a perspective view showing one example of such microwave heating apparatus. The microwave heating apparatus comprises a microstripline 1, a coaxial line 7 for supplying a microwave to the microstripline 1, and a dummy load 8. The microstripline 1 comprises a dielectric base plate 2 made of a ceramic of alumina, for example, and a wider ground conductor 3 is formed on the surface of the dielectric base plate 2. The ground conductor 3 is formed of an electrically good conductive material, such as copper and silver, and a ladder pattern 6 is formed in the part of the ground conductor 3 in the length direction. The ladder pattern 6 comprises a plurality of leakage openings or slits 5 arranged distributed in the length direction, i.e. the propagating direction of a microwave. The microstripline 1 further comprises a center plane or center conductor 4 made of silver or copper, for example, formed on the rear surface of the dielectric base plate 2 so as to be adhered thereto. Normally, the ground conductor 3 and the center conductor 4 are formed of copper plate or silver plate, the thickness of which is 0.2 mm, respectively. The width of the slits 5 in the ladder pattern 6 formed in the ground conductor 3 is 4 mm and the length thereof is about 30 mm. A microwave oscillator of such as a magnetron, not shown, is provided at the input side, i.e. at the left side as viewed in FIG. 1, of the coaxial line 7, so that the coaxial line 7 is supplied with microwave from the microwave oscillator to supply the same to the microstripline 1. A dummy load 8 is connected to the side opposite to the input side of the microwave of the microstripline 1. The dummy load 8 is aimed to absorb and consume a microwave not consumed by the ladder pattern 6, thereby to protect the microwave oscillator.

A microwave is supplied to the microstripline 1 through the coaxial line 7 upon energization of the microwave oscillator, not shown, in the above described structure. A portion of the supplied microwave is leaked through the respective slits 5 at the ladder pattern 6 formed in the ground conductor 3. Accordingly, a sheet-like material being heated 9 such as a paper sheet placed on the ladder pattern 6 is heated by the leaked microwave. Meanwhile, by providing a transfer means such as a conveyor or rollers as shown, such that the material being heated 9 is in succession transferred in the arrow direction, the material being heated 9 is in succession and continually heated.

On the other hand, the microstripline 1 for use in a conventional microwave heating apparatus has been produced in the following method. More particularly, as shown in FIG. 2, first, a plurality of slits 5 are punched, by a press, in a copper plate which is the ground conductor 3, thereby to form the ladder pattern 6. Thereafter, the ground conductor 3 having the ladder pattern 6 and the center conductor 4 are pressed while heating, so as to sandwich the dielectric base plate 2.

Normally, a microwave of about 800 W is applied to the above described microstripline 1 for use in the microwave heating apparatus. However, if and when such microwave of high power is applied to the microstripline 1, it is most likely that a spark occurs between the lattice portions 3*a*. For example, in case where the dielectric base plate 2 is formed of polyethylene tetrafluoride sheet of 0.1 mm in thickness, which has a low corona resistance, and an equivalent life time to dielectric breakdown is about 35 hours, with 50° C. of ambient temperature and an applied voltage being 3 kV with 50 Hz of frequency, and mechanical breakdown occurs ten seconds after such plate is in an arc. Thus, in general, a spark readily occurs in a microstripline 1 as shown in FIGS. 1 and 2 and hence the dielectric base plate 2 is likely to be broken due to such spark.

Then, in order to solve such problems, for example, the Japanese Patent Laying Open Gazette No. 101374/1982 (Japanese Patent Application No. 178333/1980) laid open June 23, 1982 discloses that one surface of a ladder pattern is covered with an insulating material, such as silicone resin and a glass. The Japanese Patent Laying Open Gazette No. 154791/1982 (Japanese Patent Application No. 41087/1981) laid open Sept. 24, 1982 discloses that one surface of a ladder pattern is provided with a cover made of the same insulating material, such as silicone resin, fluororesin and glass. However, in these examples, a conductor having a ladder pattern is directly disposed on a dielectric base plate and thereafter, the exposed surface of the conductor having a ladder pattern is covered with an insulating material or is provided with the cover made of an insulating material. Accordingly, a creeping discharge is caused between the interfaces of the conductor having the ladder pattern and the dielectric substrate, which means that there is still a fear that leakage may occur. Therefore, the above described solution or solutions are not sufficient for a perfect spark prevention. In addition, a coating of an insulating material over only one surface of a conductor having ladder pattern tends to be stripped off. In case of using a cover made of an insulating material, such approach has difficulty of providing precisely such cover on the ladder pattern, which makes the yield worse.

SUMMARY OF THE INVENTION

Accordingly, a principal object of the present invention is to provide a microstripline for use in microwave heating, which can completely prevent a dielectric base plate from being broken by a spark.

Briefly stated, the present invention comprises a microstripline for use in microwave heating, including a dielectric base plate having one surface and other surface and conductors each provided over the one surface and the other surface of the dielectric base plate, at least one of said conductors having a ladder pattern formed therein and said at least one conductor having the ladder pattern being sandwiched by silicone resin.

In accordance with the present invention, there is no fear that a creeping discharge may occur between the surface of the dielectric base plate and a conductor having a ladder pattern and that leakage may occur from the underside, and thus a possible spark can be completely prevented, since both surfaces of at least one conductor having a ladder pattern is covered or coated with silicone resin and then such conductor is disposed on the dielectric base plate, which means that silicone resin is interposed between the dielectric base plate surface and at least one conductor having the ladder pattern.

In a preferred embodiment of the present invention, a ladder pattern is formed in only one conductor disposed on the dielectric base plate and is not formed in other conductor disposed on other surface thereof. In addition, both conductors are sandwiched with silicone resin or is covered or coated with silicone resin. Preferably, a coating material of low friction member disposed on the surface of the above described at least one conductor coated with silicone resin. The coating material preferably comprises fluororesin.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
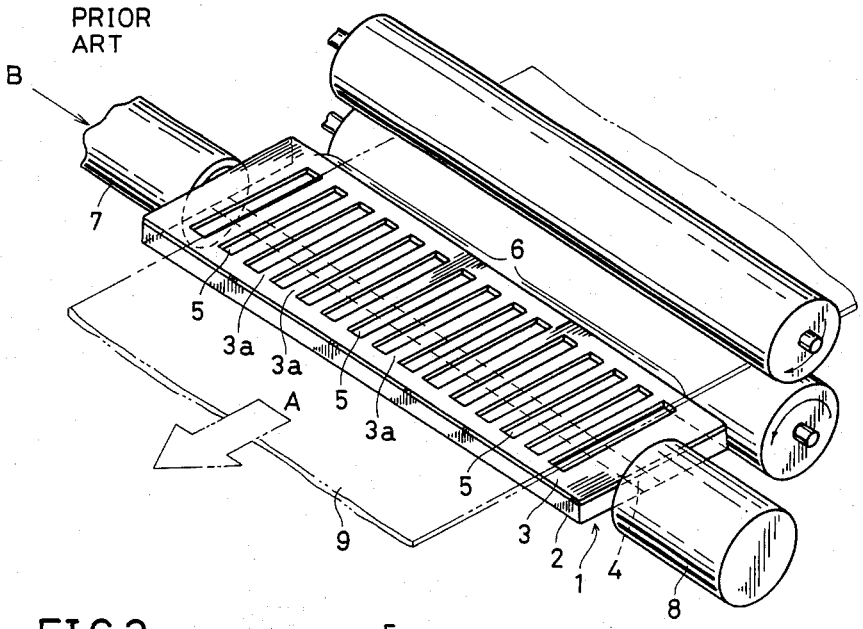
FIG.1 PRIOR ART
FIG. 1 is a perspective view showing a microwave heating apparatus utilizing a conventional microstripline.
Figure 2:
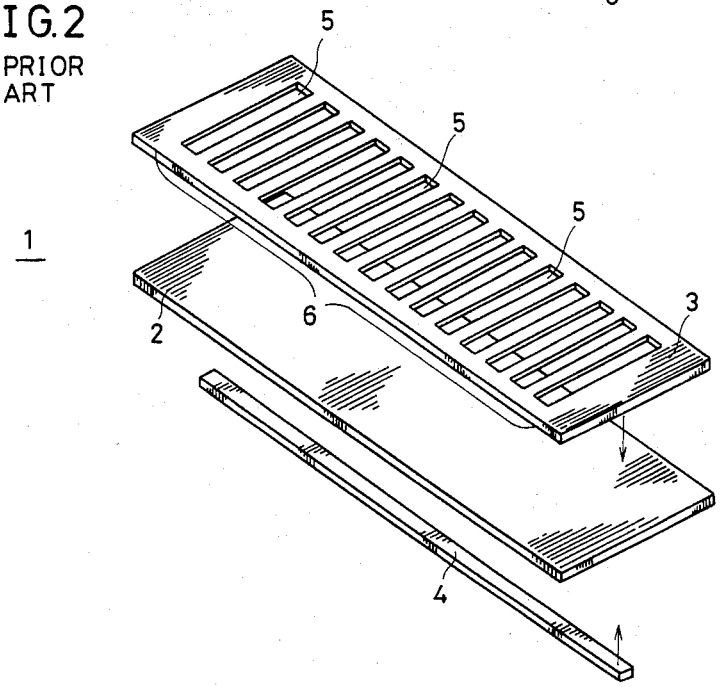
FIG.2 PRIOR ART
FIG. 2 is a exploded perspective view of a conventional microstripline used in the microwave heating apparatus in FIG. 1.
Figure 3:
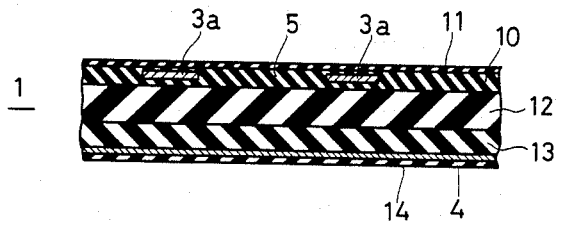
FIG. 3 is a partial expanded sectional view showing an embodiment of the microstripline in accordance with the present invention.

FIG. 3 is a partial expanded cross sectional view showing an embodiment of a microstripline in accordance with the present invention. In the embodiment, the same elements as those in conventional examples of FIGS. 1 and 2 are indicated by the same reference numerals.

As can be seen in FIG. 3, the lattice portions 3*a* are covered or coated with a first sheet 10 made of silicone rubber. Such silicone rubber is adhered to the ground conductor 3 with pressure from both of the front and rear surfaces thereof, so that a sheet 10 is made. The slits 5 are filled with such silicone rubber. The sheet 10 is coated with another sheet 11 made of fluororesin of low friction member, so that the material 9 to be heated as shown in FIG. 1, is made to easily slide on the microstripline. Such sheet 10 made of the silicone rubber is disposed on a first dielectric layer 12 made of silicone resin or silicone rubber having high arc resistance and corona resistance. A second dielectric layer 13 made of hard fluororesin is superimposed on other surface of the first dielectric layer 12. A center conductor 4 is disposed on other surface of the second dielectric layer 13. The center conductor 4 is coated with a second sheet 14 made of silicone rubber.

Since the first dielectric layer 12 is formed of silicone rubber, the layer 12 is soft and less rigid. Accordingly, in order to enhance rigidity of the dielectric base plate, the second dielectric layer 13 is formed of hard fluororesin. As a result, rigidity of microstripline 1 per se can be obtained by the second dielectric layer 13.

Figure 4:
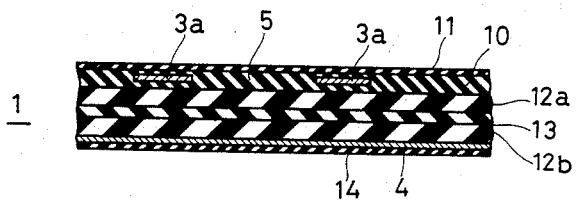
FIG. 4 is a partial expanded cross sectional view showing another embodiment of a microstripline in accordance with the present invention.

FIG. 4 is a partial expanded cross sectional view showing another embodiment a microstripline in accordance with the present invention. The points different from the FIG. 3 embodiment are that the first dielectric layer 12 is divided into two layers which sandwich the second dielectric layer 13 made of hard fluroresin. With such structure, the center conductor 4 never contacts with the hard fluororesin.

Meanwhile, the corona resistance and arc resistance of the silicone rubber are extremely high in that, with the same conditions used in explaining the prior art, that is, with ambient temperature being 50° C., applied voltage being 3 kV and frequency being 50 Hz, the equivalent life time period for dielectric breakdown is 35,600 hours and mechanical breakdown occurs 150 seconds after the dielectric base plate is placed in an arc. Accordingly, there is no fear that spark may occur between the lattice portions 3*a* and even if a spark is caused, the dielectric layer 12 is not broken due to such spark.

As shown in the FIG. 4 embodiment, generation of spark on the center conductor side can be prevented, since the dielectric 12*b* contacting with the center conductor 4 is also formed of the silicone rubber.

Furthermore, in the FIGS. 3 and 4 embodiments, no ladder pattern is formed in the center conductor 4. However, as a matter of course, a ladder pattern may be formed in the center conductor 4, as well as in the ground conductor 3.

If and when other dielectric layer having a higher rigidity rather than the silicone resin and the like is formed of fluororesin, the life time period of the microstripline can be made longer since dielectric loss of such dielectric layer is less and hence the microstripline per se is not heated more than needed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microstripline for use in a microwave heating apparatus, comprising:

a dielectric base plate having a first surface and a second surface;

a pair of conductors, one conductor of the pair being disposed adjacent the first surface of said dielectric base plate, and the other conductor of the pair being disposed adjacent the second surface of said dielectric base plate;

at least one of the conductors of the pair of conductors having a ladder pattern formed therein, the ladder pattern being defined by a plurality of slits formed in the at least one of the conductors;

the at least one of the conductors of the pair of conductors having said ladder patern being sandwiched between silicone resin; and a coating member of low friction being disposed on a surface of the at least one conductor of the pair of conductors sandwiched between the silicone resin, the coating member including fluororesin.

* * * * *